US010584530B2

(12) United States Patent
Hsu et al.

(10) Patent No.: US 10,584,530 B2
(45) Date of Patent: Mar. 10, 2020

(54) TRANSMISSION DEVICE FOR CORDLESS WINDOW SHADES

(71) Applicants: Sheng Ying Hsu, Changhua County (TW); Chun Jan Hsu, Changhua County (TW)

(72) Inventors: Sheng Ying Hsu, Changhua County (TW); Chun Jan Hsu, Changhua County (TW)

(73) Assignee: CHING FENG HOME FASHIONS CO., LTD., Changhua County (TW)

( * ) Notice: Subject to any disclaimer, the term of this patent is extended or adjusted under 35 U.S.C. 154(b) by 240 days.

(21) Appl. No.: 15/668,048

(22) Filed: Aug. 3, 2017

(65) Prior Publication Data

US 2018/0044980 A1 Feb. 15, 2018

(30) Foreign Application Priority Data

Aug. 9, 2016 (TW) ..... 105212016 U

(51) Int. Cl.

| | |
|---|---|
| ***E06B 9/42*** | (2006.01) |
| ***E06B 9/40*** | (2006.01) |
| ***A47H 23/01*** | (2006.01) |
| ***E06B 9/44*** | (2006.01) |
| *E06B 9/17* | (2006.01) |

(52) U.S. Cl.

CPC ..... *E06B 9/40* (2013.01); *A47H 23/01* (2013.01); *E06B 9/44* (2013.01); *E06B 9/17* (2013.01); *E06B 2009/405* (2013.01)

(58) Field of Classification Search

CPC . E06B 9/40; E06B 9/262; E06B 9/323; E06B 9/322; E06B 9/44; E06B 2009/3222; E06B 9/17; E06B 2009/405; E06B 9/60; E06B 2009/3225; E06B 2009/2627; A47H 23/01

See application file for complete search history.

(56) References Cited

U.S. PATENT DOCUMENTS 5,477,904 A * 12/1995 Yang ..... B60J 1/2091 160/370.23

7,143,802 B2 * 12/2006 Strand ..... E06B 9/262 160/84.04

(Continued)

OTHER PUBLICATIONS

Pending U.S. Appl. No. 15/462,898.

*Primary Examiner* — Brent W Herring

(74) *Attorney, Agent, or Firm* — Che-Yang Chen; Law Offices of Scott Warmuth

(57) ABSTRACT

A transmission device of a window shade includes a top box, a bottom bar and a shade located between the top box and the bottom bar. A first scrolling member and a second scrolling member are respectively connected to the first and second rails in the top box, and a movable unit is movably engaged with the first rail and between the first and second scrolling members. A transmission cord wraps around the first and second roller units of the movable unit, and the transmission cord wraps around the first and second roller units of the first scrolling member. Two ends of the transmission cord extend through the top box, the shade and are connected to the bottom bar. The length of the transmission cord can be stored between the first and second rollers so as to be cooperated with a longer shade.

2 Claims, 7 Drawing Sheets

(56) References Cited

U.S. PATENT DOCUMENTS 7,487,817 B2 * 2/2009 Liang ..... E06B 9/32 160/170
7,740,045 B2 * 6/2010 Anderson ..... E06B 9/322 160/84.05
7,984,745 B2 * 7/2011 Wen ..... E06B 9/322 160/170
9,297,203 B2 * 3/2016 Hsueh-Cheng ..... E06B 9/326
9,316,050 B2 * 4/2016 Hsu ..... E06B 9/262
9,574,393 B2 * 2/2017 Huang ..... E06B 9/262
9,695,633 B2 * 7/2017 Morris ..... E06B 9/262
9,732,555 B2 * 8/2017 Morris ..... E06B 9/322
9,797,188 B2 * 10/2017 Rettig ..... E06B 9/266
9,879,476 B2 * 1/2018 Sung ..... E06B 9/322
10,221,619 B2 * 3/2019 Chen ..... E06B 9/322
2007/0284060 A1 * 12/2007 Liang ..... E06B 9/32 160/170
2011/0315329 A1 * 12/2011 Hong ..... E06B 9/262 160/340
2014/0076504 A1 * 3/2014 Anthony ..... A47H 5/032 160/84.04
2014/0216664 A1 * 8/2014 Hsu ..... E06B 9/262 160/84.02
2015/0041073 A1 * 2/2015 Hsu ..... E06B 9/262 160/192
2015/0361716 A1 * 12/2015 Hsu ..... E06B 9/262 160/168.1 R
2015/0376940 A1 * 12/2015 Hsu ..... E06B 9/322 160/169
2016/0222721 A1 * 8/2016 Rettig ..... E06B 9/266
2016/0222724 A1 * 8/2016 Morris ..... E06B 9/322
2016/0222725 A1 * 8/2016 Morris ..... E06B 9/262
2016/0356081 A1 * 12/2016 Sung ..... E06B 9/306
2016/0376839 A1 * 12/2016 Huang ..... E06B 9/322 160/368.1
2017/0107075 A1 * 4/2017 Hung ..... B65H 75/4405
2017/0218694 A1 * 8/2017 Sung ..... E06B 9/322

* cited by examiner

TRANSMISSION DEVICE FOR CORDLESS WINDOW SHADES

BACKGROUND OF THE INVENTION

1. Fields of the Invention

The present invention relates to a transmission device of a window shade, wherein the parts involved in the transmission device are simplified and can be used for shorter or longer shade.

2. Descriptions of Related Art

The conventional cordless window shade known to applicant is disclosed in U.S. Pat. No. 7,487,817, and comprises transmission cords, the movable unit and the fixed unit, wherein the operation cords are wrapped to the movable unit and the fixed unit. The transmission cords are cooperated with the operation cords so that the users simply push or pull the bottom bar of the window shade to change the wrapping status of the operation cords relative to the movable unit. The operation cords and the transmission cords are cooperated with each other to achieve a balance, such that the users can lift or expand the window shade by pulling or pushing the bottom bar.

U.S. Pat. No. 9,316,050 uses a single spring to replace the controller of the movable unit disclosed in the U.S. Pat. No. 7,487,817. The spring is connected between the top box and the movable unit.

Applicant has invented the window shade with a top box, a mediate bar and a bottom bar. The top box includes a cordless device on each of two ends thereof, and the cordless devices comprise even number of transmission cords to respectively be connected to the mediate bar and the bottom bar. The mediate bar can be individually moved to form an area that does not have any slats of the shade. Therefore, the users can see the outside scene via the area. This specific arrangement is disclosed in U.S. Patent Application Publication No. 2015/0041073.

However, when the window shade has a certain length, the transmission cords have to be long enough, and the top box may not have sufficient space to accommodate the transmission cords when two sets of the scrolling units, the two movable units and the two springs are located in the top box.

In order to improve the shortcoming mentioned above, applicant invented another patent application Ser. No. 15/462,898 filed on Mar. 19, 2017, wherein the transmission cords can be increased when the length of the shade increased by specific scrolling unit and the movable unit.

The present invention intends to provide a transmission device of a window shade, wherein the scrolling units and the movable units are improved so as to be installed in the top box while the transmission cords of longer length can still be received in the top box. The operation to the cords that are connected to the mediate bar and the bottom bar is smooth.

SUMMARY OF THE INVENTION

The present invention relates to a transmission device of a window shade, and comprises a top box, a bottom bar and a shade which is located between the top box and the bottom bar. The top box has a U-shaped cross section and includes a room defined therein. A first rail and a second rail are respectively formed on the inner bottom of the room. Two apertures are defined through the top box and located between the first and second rails. A first scrolling member and a second scrolling member are respectively connected to the first and second rails. The first scrolling member has a first fixing plate and a first roller seat. The second scrolling member has a second fixing plate and a second roller seat. Each of the first and second fixing plates are fixed to the top box. The first fixing plate has a first hook and the second fixing plate has a second hook. The first scrolling member has a first roller unit and a second roller connected thereto.

A movable unit is movably connected to the first rail and includes a body. Another first roller unit and another second roller are connected to the movable unit. A transmission cord wraps around the first and second roller units of the movable unit, and the transmission cord wraps around the first and second roller units of the first scrolling member. Two ends of the transmission cord extend through the apertures, the shade and are connected to the bottom bar. The movable unit has a connection portion on one end thereof, and a resilient member is hooked between the connection portion and the second hook on the second fixing plate of the second scrolling member. When the bottom bar is pulled downward, the movable unit moves toward the first scrolling member, and the shade expands. When the bottom bar is pushed upward, the movable unit moves toward the second scrolling member by the resilient member, the shade is scrolled.

Preferably, the first roller seat includes a first separation plate which includes multiple first notches with which the first and second roller units of the first scrolling member are pivotably engaged. The second roller seat includes a second separation plate which includes multiple second notches with which the first and second roller units of the second scrolling member are pivotably engaged.

Preferably, the diameter of the first roller units is different from that of the second roller units.

Preferably, each of the first and second roller units of each of the two roller assemblies includes three disks. An axle extends through the three disks so as to define a wrapping area between any two adjacent disks.

The advantages of the present invention are that sufficient length of the transmission cord is stored in the first and second roller units in each of the first scrolling member and the movable unit, so that the transmission cord can be used in either shorter or longer shade without being limited by the room of the top box.

The present invention will become more apparent from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
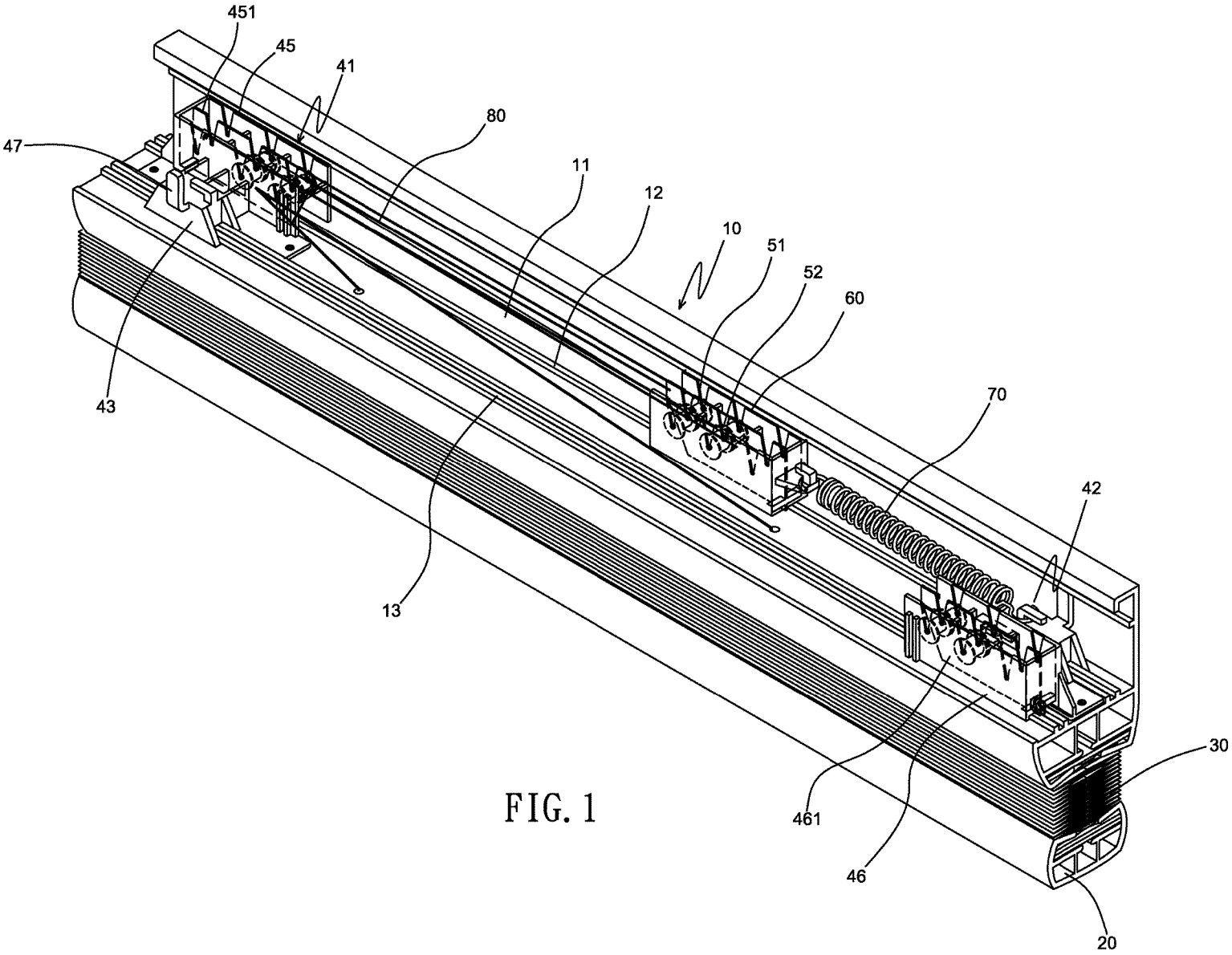
FIG. 1 is a perspective view to show the transmission device of the present invention installed to a window shade.
Figure 2:
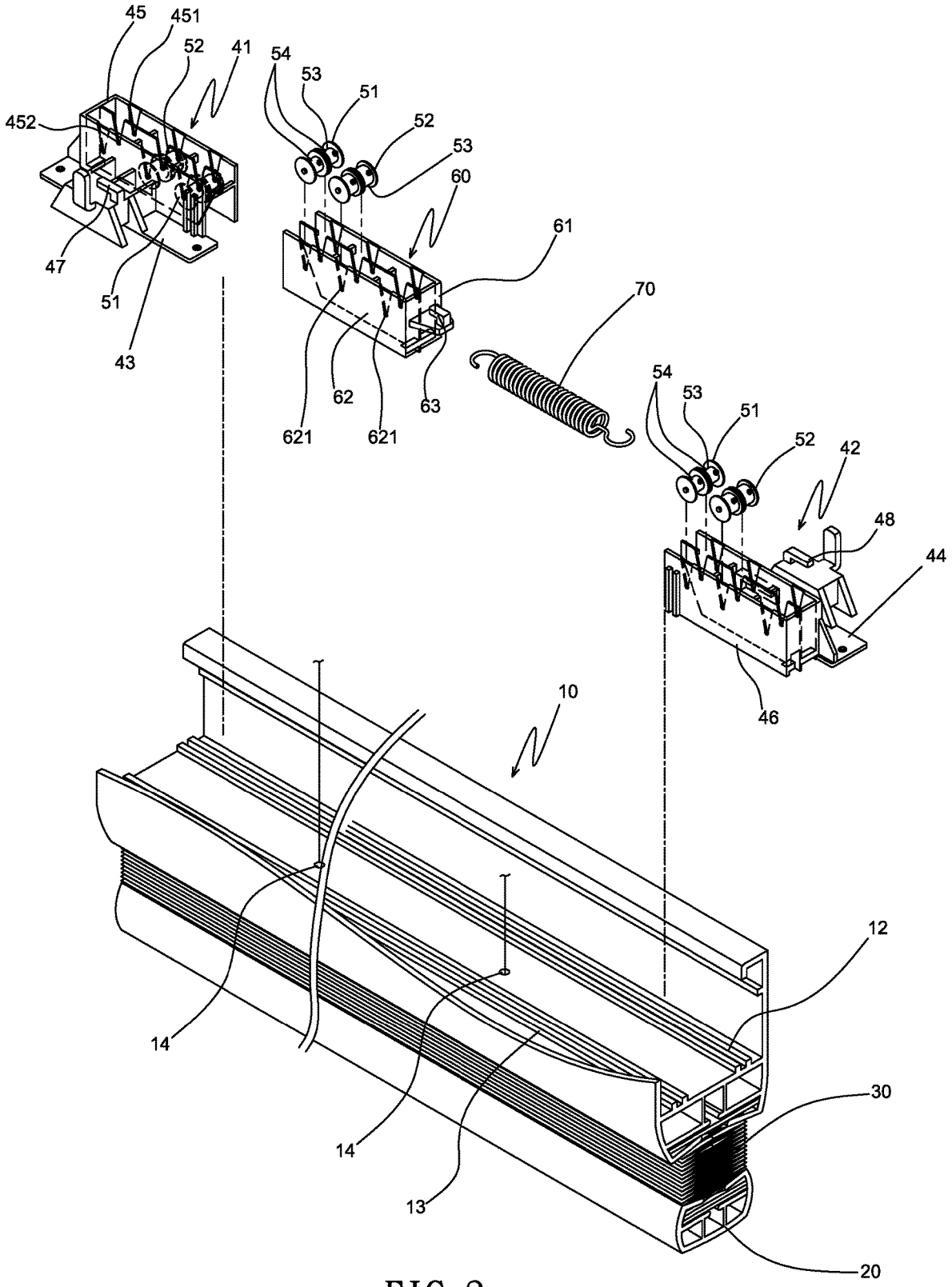
FIG. 2 is an exploded view to show the transmission device of the present invention, and the window shade.
Figure 3:
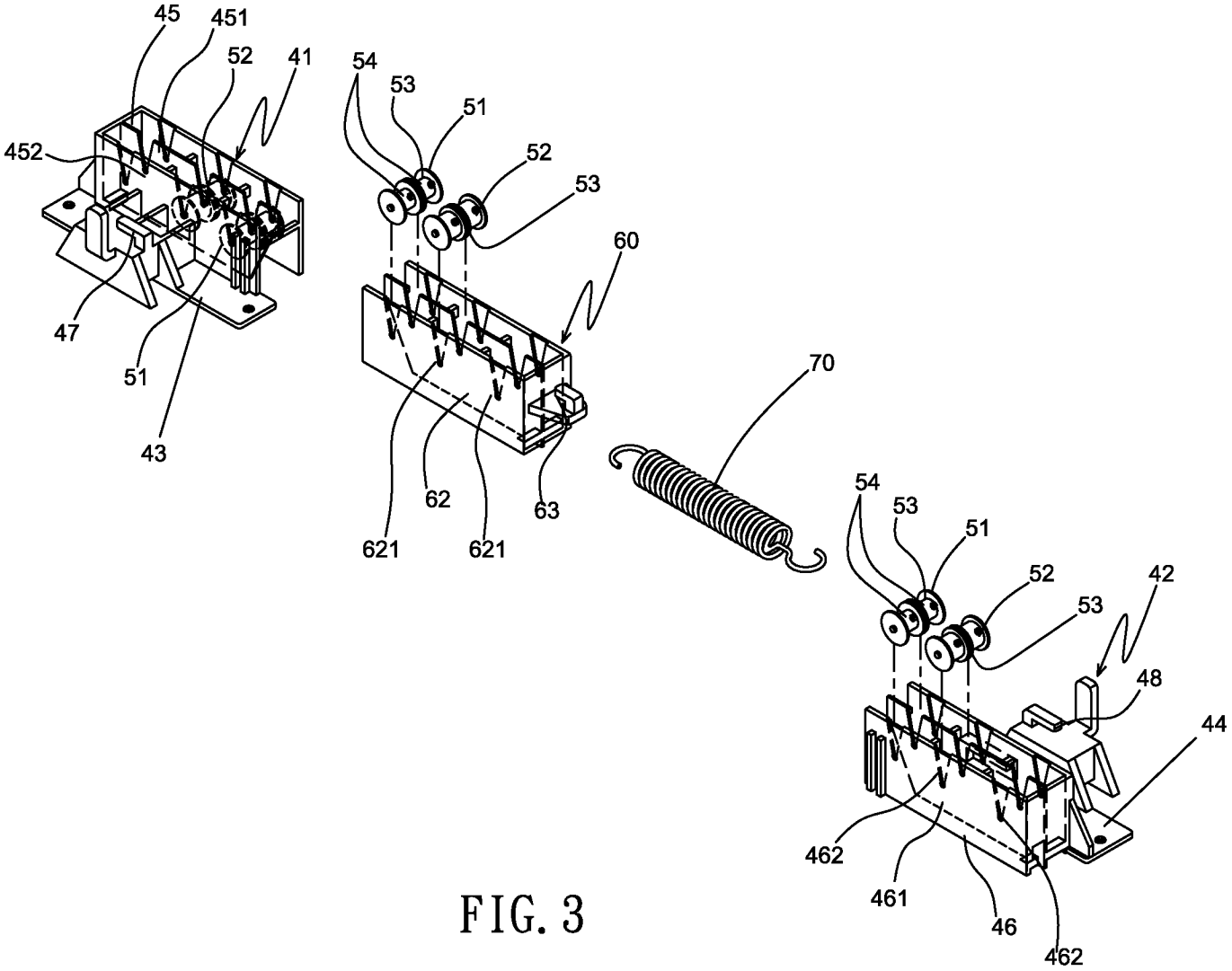
FIG. 3 is an exploded view to show the transmission device of the present invention.

Referring to FIGS. 1 to 6, the transmission device of the present invention comprises a top box 10, a bottom bar 20 and a shade 30 which is located between the top box 10 and the bottom bar 20. The top box 10 has a U-shaped cross section and a room 11 is defined in the top box 10. A first rail 12 and a second rail 13 are respectively formed on the inner bottom of the room 11. Two apertures 14 are defined through the top box 10 and located between the first and second rails 12, 13. A first scrolling member 41 and a second scrolling member 42 are respectively connected to the first and second rails 12, 13, and are located on two ends of the top box 10. The first scrolling member 41 includes a first fixing plate 43 and a first roller seat 45, and the second scrolling member 42 includes a second fixing plate 44 and a second roller seat 46. Each of the first and second fixing plates 43, 44 is fixed to the top box 10. The first fixing plate 43 has a first hook 47 and the second fixing plate 44 has a second hook 48.

The first roller seat 45 includes a first separation plate 451 which includes multiple V-shaped first notches 452 with which the first and second roller units 51, 52 of the first scrolling member 41 are pivotably engaged. The second roller seat 46 includes a second separation plate 461 which includes multiple V-shaped second notches 462 with which the first and second roller units 51, 52 of the second scrolling member 42 are pivotably engaged. The diameter of the first roller units 51 is different from that of the second roller units 52. Each of the first and second roller units 51, 52 of each of the two roller assemblies includes three disks, and an axle 53 extends through the three disks. A wrapping area 54 is formed between any two adjacent disks.

A movable unit 60 is movably connected to the first rail 12 and includes a body 61. The movable unit 60 includes a third separation plate 62 which includes multiple V-shaped third notches 621 with which another first roller unit 51 and another second roller unit 52 of the movable unit 60 are pivotably engaged.

A transmission cord 80 wraps around wrapping areas 54 of the first and second roller units 51, 52 of the movable unit 60, and the transmission cord 80 wrapping around the wrapping areas 54 of the first and second roller units 51, 52 of the first scrolling member 41. Two ends of the transmission cord 80 extend through the apertures 14, the shade 30 and are connected to the bottom bar 20. The movable unit 60 includes a connection portion 63 on one end thereof. A resilient member 70 is hooked between the connection portion 63 and the second hook 48 on the second fixing plate 44 of the second scrolling member 42.

Figure 4:
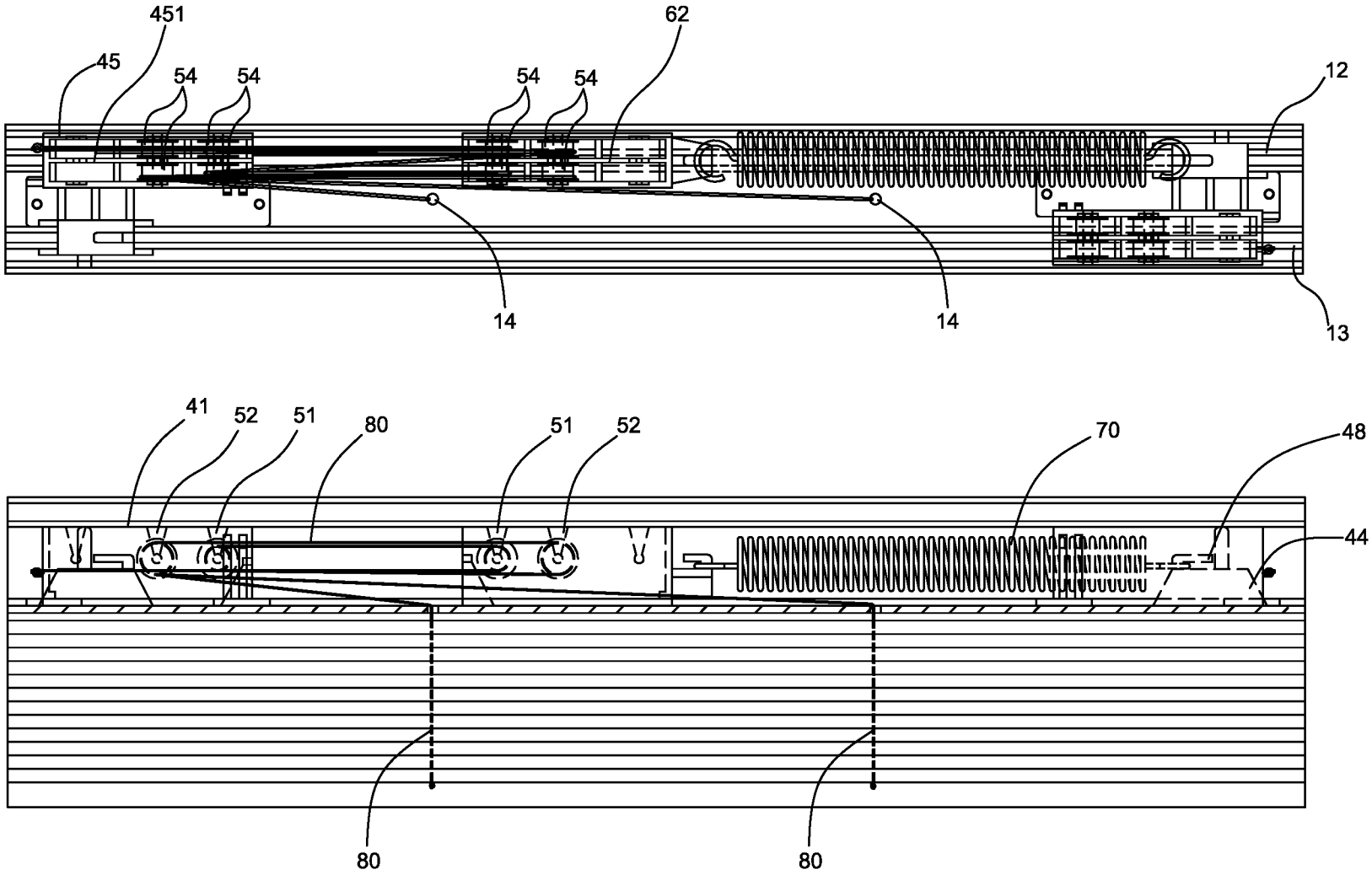
FIG. 4 shows the first operational status of the transmission device of the present invention.
Figure 5:
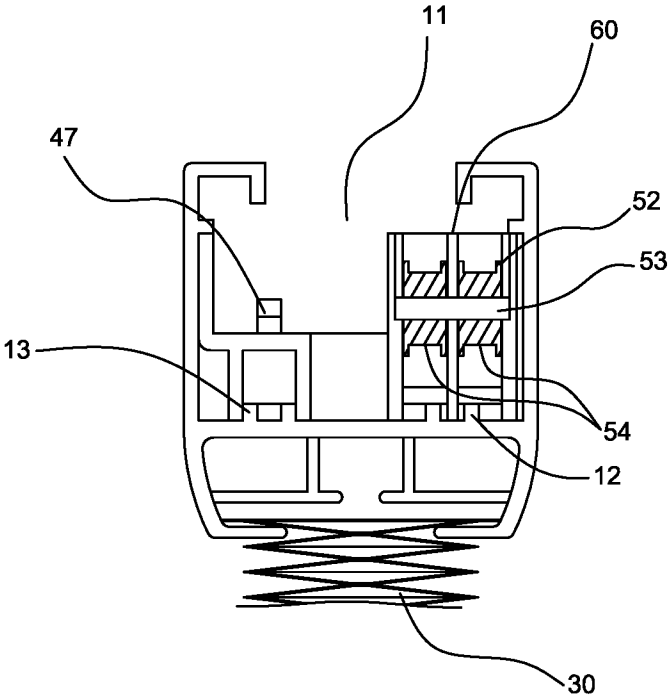
FIG. 5 is an end view of the transmission device of the present invention.

When the bottom bar 20 is pushed upward, as shown in FIG. 4, the movable unit 60 moves toward the second scrolling member 42 by the resilient member 70. The resilient member 70 is compressed, the shade 30 is scrolled. The transmission cord 80 can be stored between the first and second roller units 51, 52 of the first scrolling member 41 and the movable unit 60, so that the transmission cord 80 can be used for a longer shade 30 without worry of the size of the top box 10.

Figure 6:
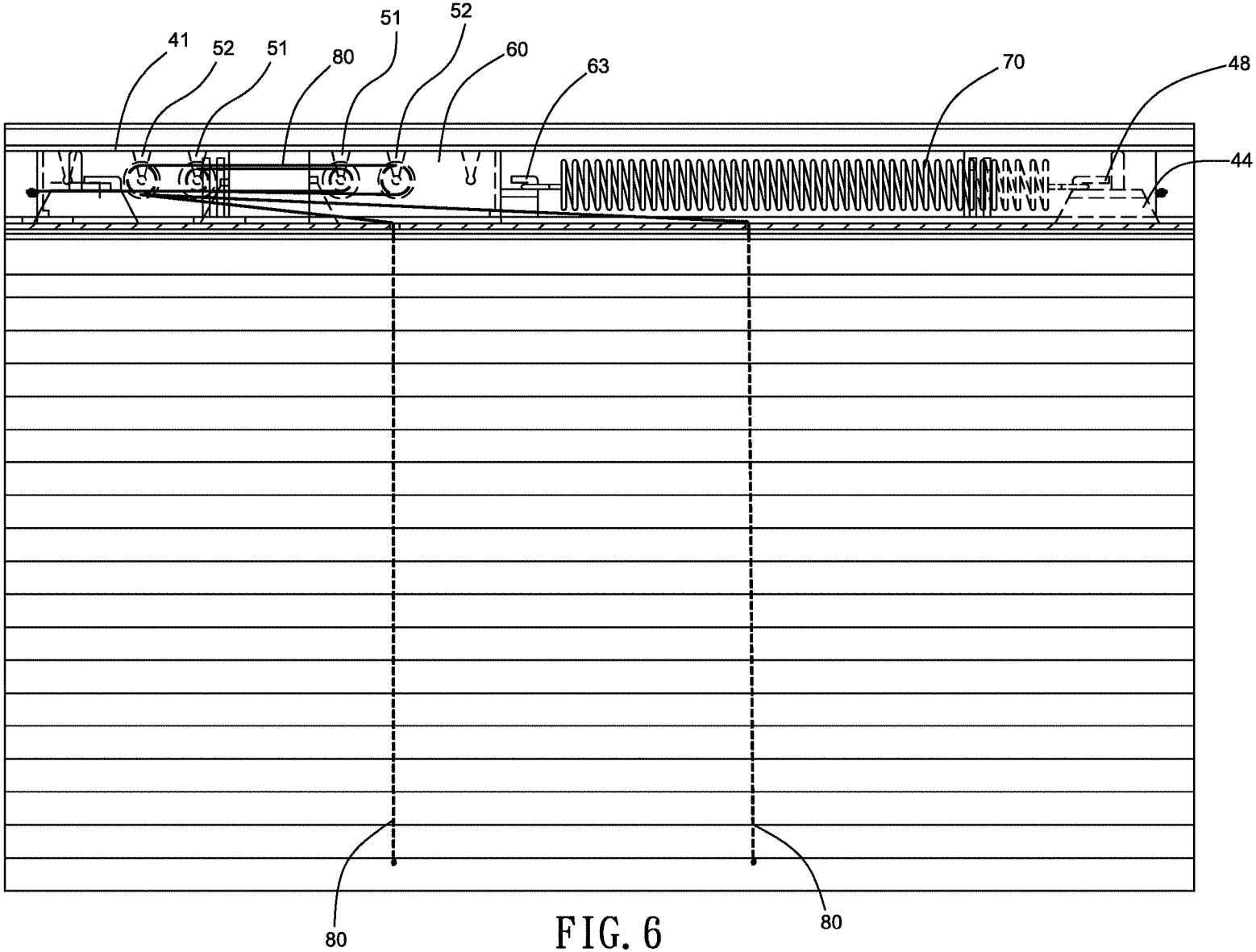
FIG. 6 shows the second operational status of the transmission device of the present invention.
Figure 7:
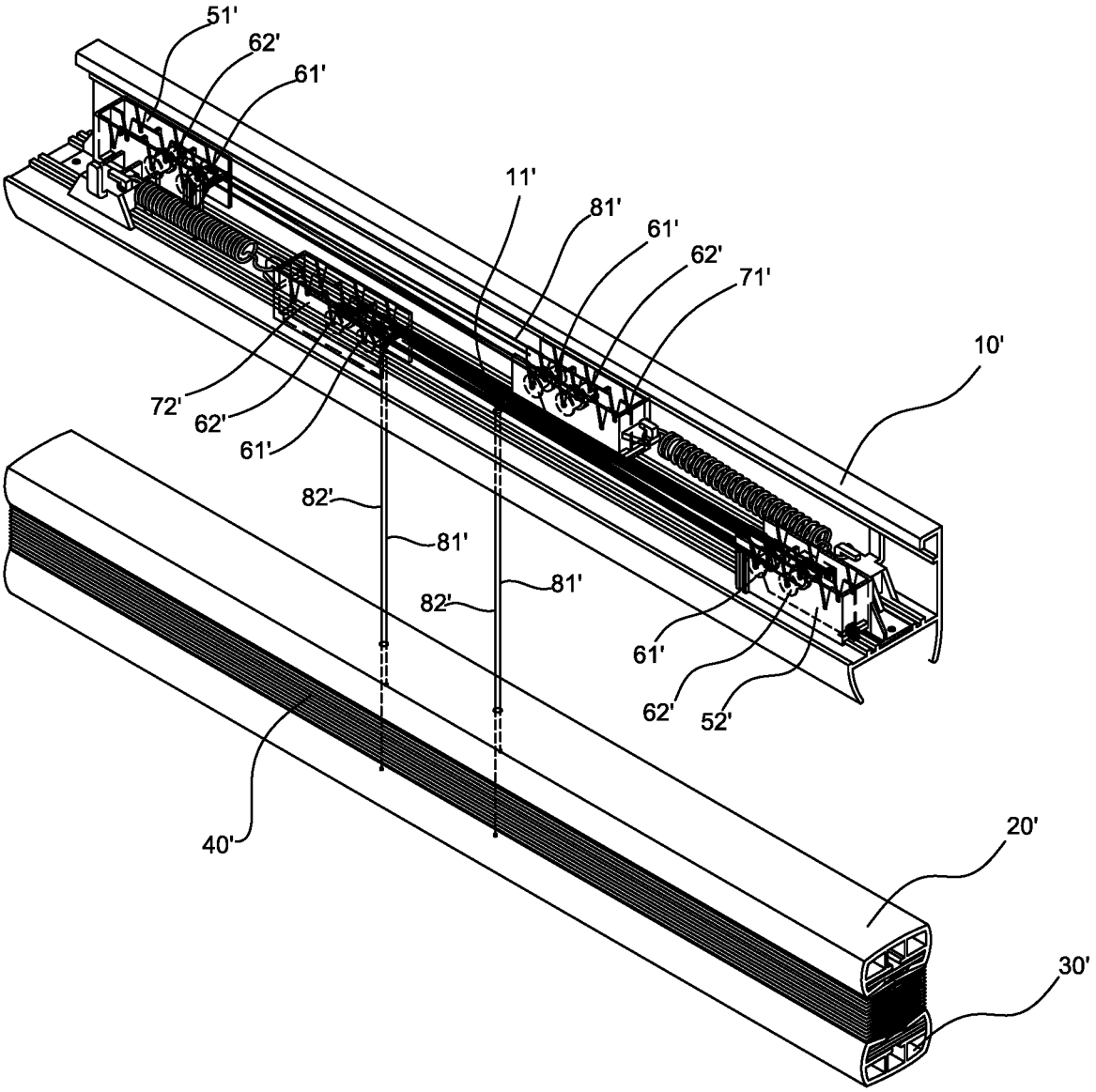
FIG. 7 shows another embodiment of the transmission device of the present invention.

When the bottom bar 20 is pulled downward, as shown in FIG. 6, the force that pulls the bottom bar 20 has to be larger than the resilient force of the resilient member 70, the movable unit 60 moves toward the first scrolling member 41. The transmission cord 80 of the first scrolling member 41 releases, and the shade 30 expands. The resilient member 70 hooking the movable unit 60 stably controls the movement of the movable unit 60, so that the shade 30 is lowered stably.

The present invention further provides another transmission device of a window shade, and comprises a top box 10', a mediate bar 20', a bottom bar 30', and a shade 40' connected between the mediate bar 20' and the bottom boar 30'. The top box 10' has a first scrolling member 51', a second scrolling member 52', both of the first and second scrolling members 51', 52' are the same as the previous embodiment. The differences between this embodiment and the previous embodiment are that this embodiment includes a first movable unit 71' and a second movable unit 72'. A first transmission cord 81' wraps around the first roller unit 61' and the second roller unit 62' of the first scrolling member 51', and then extends through apertures 11' of the top box 10 and is connected to the mediate bar 20'. A second transmission cord 82' wraps around the first roller unit 61' and the second roller unit 62' of the second scrolling member 52', and extends through apertures 11' of the top box 10, the shade 40' and is connected to the mediate bar 20'. The first scrolling member 51' controls the positioning of the mediate bar 20'. When in use, the users may pull the mediate bar 20' to adjust the area that allows light entering into the room.

While we have shown and described the embodiment in accordance with the present invention, it should be clear to those skilled in the art that further embodiments may be made without departing from the scope of the present invention.

What is claimed is:

1. A transmission device of a window shade, comprising:

a top box, a bottom bar and a shade which is located between the top box and the bottom bar, the top box having a U-shaped cross section and including a room defined therein, a first rail and a second rail respectively formed on an inner bottom of the room, two apertures defined through the top box and located between the first and second rails;

a first scrolling member and a second scrolling member respectively connected to the first and second rails, each of the first scrolling member and the second scrolling member having a first roller unit and a second roller unit connected thereto, the first scrolling member having a first fixing plate and a first roller seat, the first roller seat including a first separation plate which includes multiple first notches with which the first and second roller units of the first scrolling member are pivotably engaged, the second scrolling member having a second fixing plate and a second roller seat, each of the first and second fixing plates being fixed to the top box, the first fixing plate having a first hook and the second fixing plate having a second hook, the second roller seat including a second separation plate which includes multiple second notches with which the first and second roller units of the second scrolling member are pivotably engaged, a diameter of the first roller units is different from that of the second roller units, and a movable unit movably connected to the first rail and including a body, another first roller unit and another second roller connected to the movable unit, a transmission cord wrapping around the first and second roller units of the movable unit, and the transmission cord then wrapping around the first and second roller units of the first scrolling member, two ends of the transmission cord extending through the apertures, the shade being connected to the bottom bar, the movable unit having a connection portion on one end thereof, a resilient member hooked between the connection portion and the second hook on the second fixing plate of the second scrolling member, when the bottom bar is pulled downward, the movable unit moves toward the first scrolling member, and the shade expands, when the bottom bar is pushed upward, the movable unit moves toward the second scrolling member by the resilient member, the shade is scrolled.

2. The transmission device of a window shade as claimed in claim 1, wherein each of the first and second roller units of each of the two roller assemblies includes three disks, an axle extends through the three disks, a wrapping area is formed between any two adjacent disks.

* * * * *